United States Patent [19]

Heinisch et al.

[11] Patent Number: 4,709,312

[45] Date of Patent: Nov. 24, 1987

[54] FLOODLIGHT WITH IMPROVED REFLECTOR SYSTEM

[75] Inventors: Richard V. Heinisch; Ian Lewin, both of Scottsdale, Ariz.

[73] Assignee: Ruud Lighting, Inc., Racine, Wis.

[21] Appl. No.: 877,745

[22] Filed: Jun. 24, 1986

[51] Int. Cl.[4] ..... F21V 7/00

[52] U.S. Cl. ..... 362/298; 362/346

[58] Field of Search ..... 362/298, 346, 297, 303, 362/307, 804

[56] References Cited

U.S. PATENT DOCUMENTS

| | | | |
|---|---|---|---|
| 1,913,517 | 6/1933 | Smith et al. | 362/298 |
| 2,018,829 | 10/1935 | Berry | 362/298 |
| 2,629,815 | 2/1953 | Grupan et al. | 362/346 |
| 3,609,340 | 9/1971 | Habro | 362/298 |
| 3,643,089 | 2/1972 | Marantz | 362/346 |
| 4,293,901 | 10/1981 | Hernandez | 362/346 |
| 4,349,866 | 9/1982 | Molnar | 362/298 |
| 4,450,513 | 5/1984 | Guggemos | 362/346 |
| 4,517,631 | 5/1985 | Mullins | 362/298 |
| 4,519,019 | 5/1985 | Hall | 362/298 |
| 4,531,180 | 7/1985 | Hernandez | 362/346 |

*Primary Examiner*—Raymond A. Nelli

*Attorney, Agent, or Firm*—Peter N. Jansson

[57] ABSTRACT

A cut-off floodlight of the type having a straight light line, a reflector surface in a housing, and a light-emitting opening, and characterized by a reflector surface with a major portion parallel to the light line including a parabolic section on one side of the light line with its focus at and its vertex behind and to said one side of the light line to establish a main beam direction at an acute angle to the opening plane, and an opposite section on the other side of the light line to reflect light therefrom past the light line onto the parabolic section so its secondary reflection off the parabolic section will be close to the main beam direction.

17 Claims, 5 Drawing Figures

FLOODLIGHT WITH IMPROVED REFLECTOR SYSTEM

FIELD OF THE INVENTION

This invention is related generally to floodlights and, more particularly, to floodlights with reflector systems for controlled angled light discharge.

BACKGROUND OF THE INVENTION

A great variety of floodlights have been disclosed and used in the prior art. Among these are many with lenses or other refractive structures over their light sources to aim the light being emitted, and many others using reflectors behind their light sources for the same purpose. This invention deals with floodlights of the latter type.

Such floodlights include a light source and one or more reflector surfaces with a case. These floodlights have a light-emitting opening, which is often planar and which may be covered by a light-transmissive cover, preferably a transparent cover made of glass or the like.

In recent years, substantial efforts have been directed toward development of reflector-type floodlights which direct emitted light in a predetermined off-center direction, that is, in a direction which is not normal (perpendicular) to the light-emitting opening plane, in order to satisfy certain types of lighting requirements. One such type of reflector floodlight is referred to as a "cut-off" floodlight because the area which it is intended to iluminate is well defined. If floodlights have well-defined areas of illumination, a number of them can be arranged for more efficient use of power in lighting large areas.

To best describe some of the deficiencies and problems with cut-off floodlights of the prior art, it will be helpful first to describe briefly a typical cut-off floodlight. The cut-off floodlight has a light-emitting opening plane which is generally on the lower side of the floodlight housing when it is in use. Light is directed downwardly, of course, and by virtue of reflectors within the housing is directed at least to some extent toward one side—often referred to as the front. The front edge of the emitted light has a cut-off location, beyond which it is desirable to have as little light emitted as possible.

Such cut-off reflector-type floodlights of the prior art often have had substantial glare and spill light beyond their cut-off points (lines). As a result, such floodlights are less efficient in operation than desirable.

A very significant problem with such cut-off floodlights is that their main beam directions are quite close to the aforementioned normal (perpendicular) direction. That is, the main beam direction is not angled enough in the forward direction. As a result, too much light intensity is concentrated on positions immediately below or close to immediately below the light, and the illuminated areas approaching the forward cut-off point are insufficiently lit.

It is very typical with such cut-off floodlights that the main beam direction is about 20 degrees in front of the normal (perpendicular) direction, while the cut-off angle may be on the order of 80 degrees from perpendicular (when the light-emitting opening plane is horizontal). This provides inadequate evenness of light distribution over the area to be illuminated.

Because of such deficiencies in cut-off reflector floodlights of the prior art, it is often necessary to mount the floodlights with their light-emitting openings tilted toward the forward direction. Such tilting, of course, shines more light toward the forward direction. But tilting also moves the cut-off point so that light is being wasted. This represents an inefficient use of light. And, it is important to note that the tilting of such floodlights increases the possibility of water ingress, with all the attendant disadvantages.

In cut-off reflector-type floodlights, it is desirable that the main beam direction be directed more toward the front without the need to tilt the lamp such that the light-emitting opening is away from a horizontal orientation. Stated differently, it is highly desirable for the angle of the main beam direction to be much closer to the cut-off angle, so that the entire area is lit more evenly and efficiently.

As previously suggested, it is desirable to have a more distinct front cut-off to minimize spill light and glare beyond the cut-off. And, it is desirable to reduce concern about water ingress by providing a floodlight which can be used more often with the light-emitting opening in a horizontal orientation.

SUMMARY OF THE INVENTION

This invention is an improved cut-off floodlight overcoming some problems and deficiencies of floodlights of the prior art. The cut-off floodlight of this invention has an improved reflector system which provides an improved forwardly-directed illumination using controlled angled beams. This improves efficiency of light use and significantly reduces wasted light.

The floodlight of this invention is of the type having a high-intensity discharge lamp with a straight-line light source such as a high-pressure sodium lamp or a metal halide lamp) and a reflector surface in a housing, and a light-emitting opening plane. The light-emitting opening plane is generally parallel to the light line, and the reflector surface extends to and defines the opening plane, as is the case with certain devices of the prior art.

The floodlight of this invention is characterized by an improved reflector surface. The major portion of the reflector surface is parallel to the light line. This parallel major portion of the reflector surface is a surface described by movement of a line which is parallel to the light line. The parallel major portion includes a parabolic section on one side of the light line and an opposite section on the other side of the light line.

The parabolic section of the parallel major portion has its focus at the light line and its vertex behind and to one side (the back side) of the light line to establish a forward main beam direction which is at an acute angle to the opening plane well less than 90 degrees. The opposite section of the parallel major portion of the reflector surface is configured and oriented to reflect light from the light line past the light line and onto the parabolic surface so its subsequent reflection off the parabolic section will be in a direction close to the main beam direction.

The parabolic section preferably extends from a position near the opening plane and through the vertex position to terminate at a first position behind (that is, above) the light line. Thus, the parabolic section includes parts of the parabola on both sides of its vertex. The part extending from near the opening plane to the vertex is much longer than the part from the vertex to the first position, where the parabolic section ends.

The section of the parallel major portion of the reflector surface which is referred to as the "opposite section" preferably extends from a second position behind (that is, above) the light line to a third position generally beside (that is, forward of) the light line. The shape and orientation of the opposite section is such that positions thereon progressively closer to such third position are progressively closer to the light line.

The parallel major portion of the reflector surface preferably also includes a connecting section between the parabolic section and the opposite section. More specifically, such connecting section extends betwen the aforementioned first and second positions and is configured and oriented to reflect light from the light line past the opposite section at a position near the second position, that is, just off the end of the opposite section, and from there through the opening plane.

In highly preferred embodiments, the opposite section includes a spiral section configured and oriented to reflect light from the light line through a position immediately behind the light line and from there onto the parabolic section. Such spiral configuration is chosen to reflect light from the light line, regardless of what portion of the section the light hits, through a tightly confined area, actually a short spiral locus of points, located immediately behind (above) the light line, and from there onto the parabolic section.

More specifically described, the spiral section is a logarithmic spiral—also known as an equiangular spiral. Such spiral section extends from the aforementioned third position, which is relatively close to the light line, to a fourth position between the aforementioned second and third positions, which is more remote from the light line.

The direction of light reflected from such spiral section, which is very close to being tangential to the cylindrical tube or other such member forming the light line, makes the subsequent secondary reflections off the parabolic section very close in direction to the beam direction, in which light directly from the light line is reflected off the parabolic section. This is referred to herein as "just off-parallel" to the main beam direction. The parabolic section "sees" reflected from the spiral section as coming from very near to the light line.

In certain preferred embodiments, the parallel major portion also includes a partial semi-parabolic section which extends between the aforementioned third position and the opening plane. As used herein "semi-parabolic" refers to the portion of a parabola on only one side of its vertex, and "partial" means that only a part of one side of a parabola, not including the vertex of the parabola, is involved. such partial semi-parabolic section has its focus at the light line and is oriented to reflect light from the light line in the main beam direction, as established by the earlier described parabolic section.

The parabola of which such semi-parabola is a part would have its vertex somewhere on the line formed by the positions of the light line and the vertex of the parabolic section earlier described. That is why light coming from the light line directly to the partial semi-parabolic section is reflected therefrom in the same direction as light which comes from the light line directly to the parabolic section is reflected.

In preferred embodiments, the reflector surface also includes a pair of facing end portions which are substantially symetrical in mirror image. The facing end portions intersect the parabolic and opposite sections of the major portion of the reflector surface. Furthermore, the facing end portions are intersected by the line defined by the light line. In deed, a bulb which supports the light line may extend through an opening in one of the end portions.

The end portions are oriented at an angle to increase the efficiency of the floodlight. More specifically, the end portions are oriented such that the spacing between them, along lines parallel to the light line, is progressively greater at positions progressively closer to the opening plane. Such end portions are preferably substantially planar.

In the most preferred cases, such facing end portions are oriented such that the spacing between them, along lines parallel to the light line, is progressively shorter at positions progressively closer to the parabolic section of the major portion of the reflector surface, which, of course, means that such spacing is progressively greater at positions progressively closer to the opposite section of the major portion of the reflector surface. This preferred end portion orientation allows the end portions to reflect light, which is reflected thereon from the opposite section, onto the parabolic section for subsequent tertiary reflection through the opening plane. This increases the light outflow in directions close to the main beam direction.

In highly preferred embodiments of this invention, the light-emitting opening plane is covered by a flat lighttransmissive cover member. Such cover member is transparent to avoid any diffusion of light passing therethrough. The cover member is most preferably coincident with the opening plane.

The reflector system of this invention provides highly efficient use of the light. The emitted light is distributed with improved evenness in a forward direction when compared to cut-off floodlights of the prior art.

Using the principles of this invention, a cut-off floodlight can have a main beam direction at an angle as much as or more than 50 degrees off vertical. This is 50 degrees off a 90-degree angle to its opening plane, or, stated differently, 40 degrees to the opening plane. And, the main beam direction can be a good deal closer to a reasonable cut-off angle (which may be 70 degrees from vertical, or, stated differently, 20 degrees from the opening plane) than is cut-off floodlights of the prior art.

In addition, the cut-off floodlight of this invention provides a cut-off which has improved distinctness when compared to devices of the prior art. The amount of glare and spill light beyond the forward cut-off line is minimized.

In a highly desirable form, the floodlight of this invention has a generally rectangular housing defining a light-emitting opening plane at the lower surface thereof which is covered by a flat transparent cover, made of glass or some other transparent material. When such floodlight is mounted with the light-emitting opening plane in a horizontal orientation, it illuminates an area which is centered well toward the forward direction, rather than closer to a position directly below the light-emitting opening. This sort of controlled beam is highly beneficial in many applications, such as parking lots, business sites, and the like.

OBJECTS OF THE INVENTION

It is an object of this invention to provide a floodlight overcoming some of the problems and shortcomings of devices of the prior art as described above.

Another object of this invention is to provide a floodlight with improved reflectors for controlled area lighting.

Another object of this invention is to provide an improved reflector-type floodlight which gives greater evenness in light distribution in a predetermined off-center direction.

Another object of this invention is to provide an improved "cut-off" floodlight with excellent light distribution at angles well away from perpendicular.

Still another object of this invention is to provide a cut-off floodlight with reduced spill light and glare beyond a forward cut-off line.

Another object of this invention is to provide a cut-off floodlight in which the angle of the main beam direction is relatively close to the cut-off angle.

Still another object of this invention is to provide a cut-off floodlight which may illuminate large areas relatively evenly with its light-emitting opening oriented horizontally to minimize water ingress.

Another object of this invention is to provide a cut-off floodlight having improved efficiency of operation.

These and other objects will be apparent from the following additional descriptions and from the drawings, wherein:

DETAILED DESCRIPTION OF PREFERRED EMBODIMENT

Figure 1:
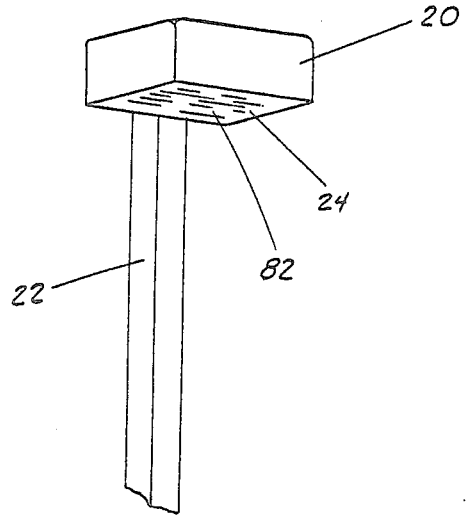
FIG. 1 is a perspective view of a cut-off floodlight in accordance with this invention, attached at the top of a mounting pole.
Figure 2:
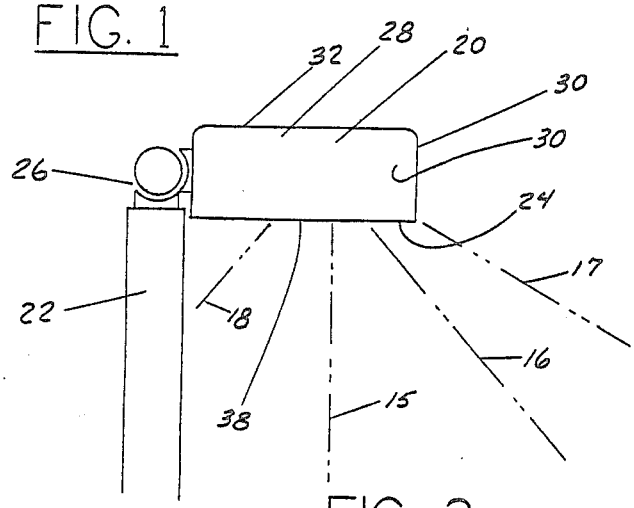
FIG. 2 is a side elevation of FIG. 1.

The figures show a cut-off floodlight 20 in accordance with this invention. FIGS. 1 and 2 show floodlight 20 mounted atop vertical mounting pole 22 with its light-emitting surface 24 facing in a generally downward direction. Floodlight 20 is secured to mounting pole 22 by a pivot mount 26, which allows floodlight 20 to be tilted. However, floodlight 20 may more frequently (than cut-off floodlights of the prior art) be mounted with its light-emitting surface 24 in a horizontal orientation.

Floodlight 20 includes a housing 28 which is generally rectangular in shape. Housing 28 is preferably a seamless aluminum casting, having continuous lateral surrounding walls 30 integrally formed with a backing plate 32. Lateral surrounding walls 30 terminate in an edge 34 which forms an access opening 36 on the lower side of housing 28. Access opening 36 is the only opening in housing 28. All of edge 34 falls in a single plane, referred to herein as a light-emitting opening plane 38.

Secured within housing 28 are a lamp socket 40, a lamp 42, reflectors 44, a ballast 46, and a capacitor, an ignitor, and wires (not shown). The means for attaching these components to housing 28 or each other form no part of this invention and would be apparent to those skilled in the art and familiar with this invention. Therefore, other than a description of the means for securing reflectors 44, the connections of components within housing 28 will not be described.

Lamp 42 includes a straight tubular light-emitting member 48 enclosed within a glass bulb 50. Tubular light-emitting member 48 is frequently referred to herein as "light line" 48. Lamp 42 is preferably a high-intensity discharge lamp such as a high pressure sodium lamp or a metal halide lamp. Each of such lamps has a tubular light-emitting member such as light line 48.

Unlike a true line, of course, light line 48 has width and light from it will come from any part of that width. For ease of description, the optical characteristics of this invention will be described as if light line 48 were a true line.

The axis of tubular light-emitting member 48 is substantially parallel to light-emitting opening plane 38 and is at a position about midway between opening plane 38 and backing plate 32 of housing 28. Light line 48 is surrounded on all sides, other than the side including opening plane 38, by a system of reflectors 44 having surfaces facing light line 48 in various ways. The shapes, arrangement and orientation of the reflectors 44 are very important to the functioning of this invention.

Before a detailed description of the reflector system of the floodlight of this invention, attention is directed again to FIG. 2 for a description of certain significant directions of light being emitted through opening plane 38. With opening plane 38 in a horizontal orientation as illustrated, light rays which are perpendicular to opening plane 38 are vertical. These are identified by numeral 15. The main beam direction, which is generally forward of the perpendicular beam direction, is identified by numeral 16. The front cut-off angle is identified by numeral 17, and the back cut-off angle by numeral 18.

The reflector surface of this invention includes a major portion 52 parallel to light line 48. In this case, "parallel" means that major portion 52 is a surface that could be generated by movement of a straight line which is parallel to light line 48 throughout such movement. An imaginary plane perpendicular to and intersecting the axis of light line 48 would be intersected by major reflector surface portion 52 at the same line pattern thereon regardless of the loaction of such imaginary plane along the axis of light line 48. Parallel major portion 52 of the reflector surface can be described by the movement of a line which is substantially parallel to light line 48 along a surface-defining path in a plane normal to light line 48. Such surface-defining path is seen in the schmatic view of FIG. 5, extending from point A successively through points V, B, C, D, E and F.

Parallel major portion 52 extends from a rear edge 54 (at point A) near opening plane 38 through several different sections to terminate in a forward edge 56 (at point F) which also is near opening plane 38. The several sections of parallel major portion 52 are described in order beginning at rear edge 54 and terminating at forward edge 56.

Figure 5:
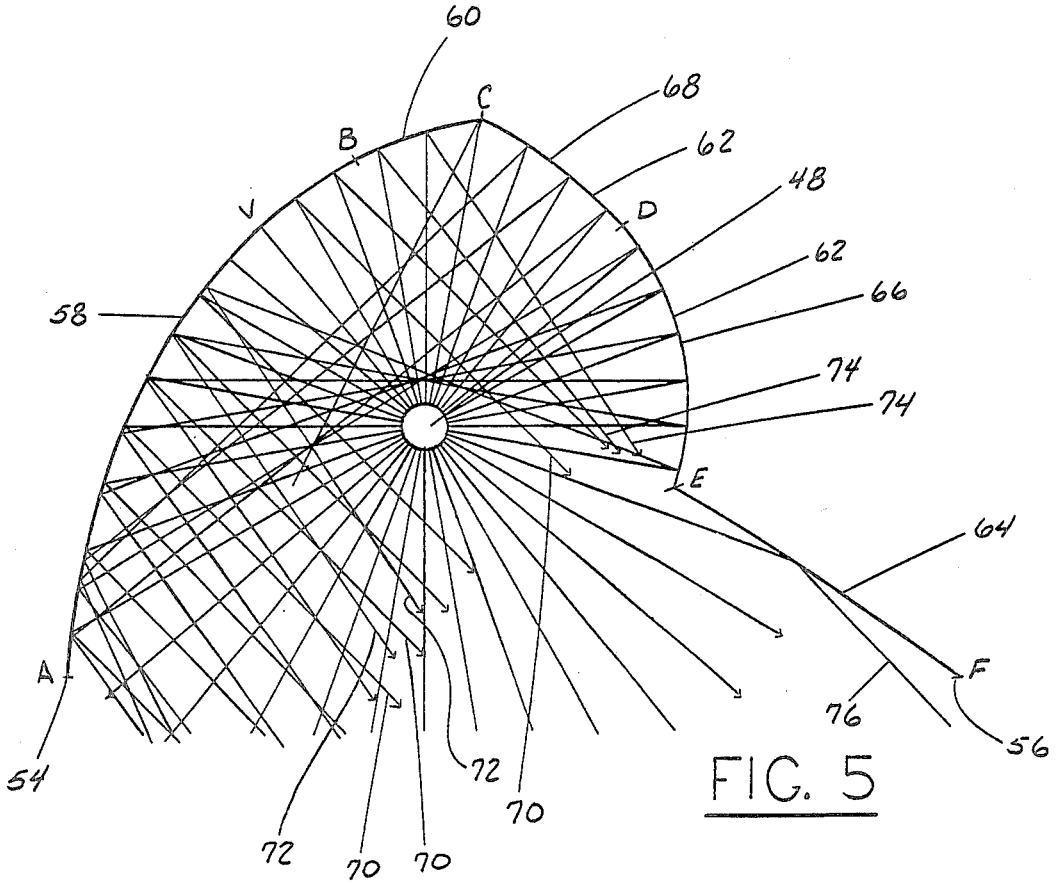
FIG. 5 is an enlarged schematic side view of the major portion of the reflector surface, illustrating its operation.

The sections include: a parabolic section 58 extending between points A and B, as illustrated in FIG. 5; a connection section 60 extending from point B to point C; an opposite section 62 extending from point C through point D to point E; and a partial semi-parabolic section 64 extending from point E to point F. Opposite section 62, referred to as "opposite" because of its position facing parabolic section 58, itself has two sections. These include a spiral section 66 extending between points D and E and a remaining section 68 extending between points C and D. Sections 60 and 68 serve as "concentrating" sections.

Parabolic section 58 is on one side of light line 48 with its focus at light line 48. The vertex of the parabola of parabolic section 58 is located at point V in FIG. 5. A line from vertex V through the center of light line 48 is at an angle of about 45 degrees to opening plane 38. The parabolic shape of section 58 and the location of light line 48 at the focus of the parabola causes light hitting section 58 directly from light line 48 to be reflected generally in a main beam direction, indicated by parallel ray arrows identified in FIG. 5 by numeral 70. The main beam direction is at an acute angle of about 45 degrees to opening plane 38, or, stated differently, at an angle of about 45 degrees from a line perpendicular to opening plane 38.

Note that parabolic section 58 includes portions from both sides of the vertex of the parabola. Parabolic section 58 terminates at point B, which is sometimes referred to herein as a first position. As will be more fully explained later herein, if parabolic section 58 extended much further, its reflections of light from such further portion would not exit through light-emitting opening plane 38, but hit a part of opposite section 52. That factor limits the extent of parabolic section 58.

Opposite section 62 is on the other side of light line 48 and is configured and oriented to reflect light from light line 48 back past light line 48 onto parabolic section 58 so that its secondary reflections off parabolic section 58 will be close to the main beam direction. Some of such secondary reflections are indicated by ray arrows which are identified by the numeral 72. The position and orientation of opposite section 62 strongly reinforces the angled beams of light which are emitted from floodlight 20 in a forward direction.

As shown in FIG. 5, opposite section 62 extends from point C, often referred to herein as a secondary position, to point E, often referred to as a third position. Positions along opposite section 62 are progressively closer to light line 48 as they are progressively closer to the third position (point E).

Spiral section 66, which is the major portion of opposite section 62, is configured and oriented to reflect light received from light line 48 through a tightly confined area, in theory a short spiral locus of points, located immediately behind (above) light line 48 so that its subsequent secondary reflection off parabolic section 58 is very closely parallel to (that is, just "off parallel") the main beam direction. As noted earlier, spiral section 66 extends from point 3 (the "third position") to point D, which is sometimes referred to as a fourth position between the second and third positions (points C and E, respectively). Spiral section 66 is a logarithmic (or "equiangular") spiral, providing primary reflection from any point thereon through the tightly confined area just behind light line 48.

Spiral section 66 must end at or near point D, because if the spiral configuration extended further toward point C the reflections of light from light line 48 off any such extended spiral surface would not hit parabolic surface 58 as intended, but would pass through light-emitting plane 38 near point A. Any such emissions would be at an angle quite opposite from what is intended. Therefore, remaining section 68 of opposite section 62 is not a continuation of the logarithmic spiral of spiral section 66, but is a minor light-concentrating section configure and oriented to reflect light onto parabolic section 58, although not passing closely behind light line 48.

Because the third position (point E), which is one of the ends of spiral section 66, is closer to light line 48 than other positions along opposite section 62, it would block reflections from parabolic section 58 if parabolic section 58 were to extend beyond the first position (point B). This would interfere with the intended purpose of providing an angled discharge as much as possible. Rather than extending parabolic section 58, connecting section 60 extends between the first and second positions (points B and C, respectively) and is configured and oriented to serve as a concentrating section reflecting light from light line 48 just past opposite section 62 near the third position (point E), and from there through light-emitting opening plane 38.

Thus, connecting section 60 provides a reflected beam from light line 48 which contributes to the angled light emission of floodlight 20. Connecting section 60 has the effect of widening the lower edge of the emitted beams, because the reflected light from connecting section 60, which is identified by ray arrows 74, extends across the light moving in the main beam direction.

Parallel major portion 52 of the reflector surface takes a radiaclly different direction in partial semi-parabolic section 4, which extends between points E and F. Partial semi-parabolic section 64 helps to define the front cut-off angle, which is illustrated by line 17 in FIG. 2. And partial semi-parabolic section 64 reflects light from line 48 in the main beam direction. See numeral 76 identifying a ray of light reflected from semi-parabolic section 64.

For such reflections to be in the main beam direction, the shape of semi-parabolic section 64 is determined by a parabola having its focus on light line 48 and being oriented in the same direction as the parabola of parabolic section 58. Partial semi-parabolic section 64 does not include its vertex; its vertex would be somewhere on the line defined by the positions of the light line and the vertex of parabolic section 58.

The extent to which light line 48 is recessed into the reflector system of this invention will play a role in the distinctness of the cut-offs. Note that in the embodiment illustrated light line 48 is spaced sufficiently from light-emitting opening plane 38 such that very little light directly from light line 48 will exit opening plane 38 at an angle more forward than the main beam direction. Thus, the front cut-off will be quite distinct, with little spill light. The configuration of the reflector system in this invention makes such sharp cut-off possible.

The back cut-off is less distinct, since a significant amount of direct (non-reflected) light will exit opening plane 38 at an angle across the main beam direction.

The reflector surface also includes a pair of facing planar end portions 78 and 80, which are substantially symetrical in mirror image. end portions 78 and 80 intersect parabolic, opposite and connecting sections 58, 62 and 60, respectively, of major portion 52 of the reflector surface, and are themselves intersected by the axis of light line 48. End portion 78 has an opening 82 through which lamp socket 40 extends.

Figure 3:
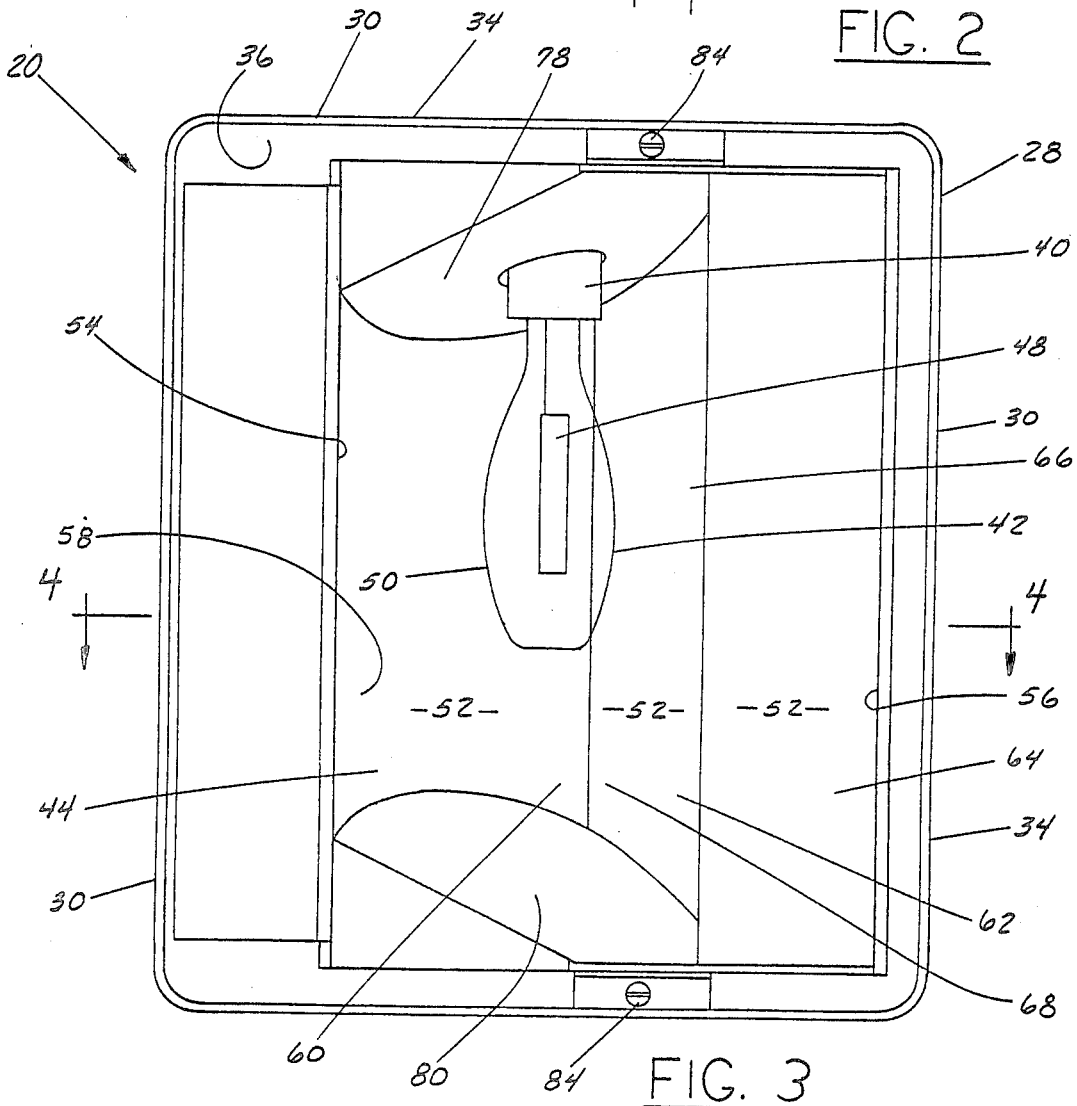
FIG. 3 is an enlarged bottom plan view of the cut-off floodlight itself, with its light-transmissive cover removed.
Figure 4:
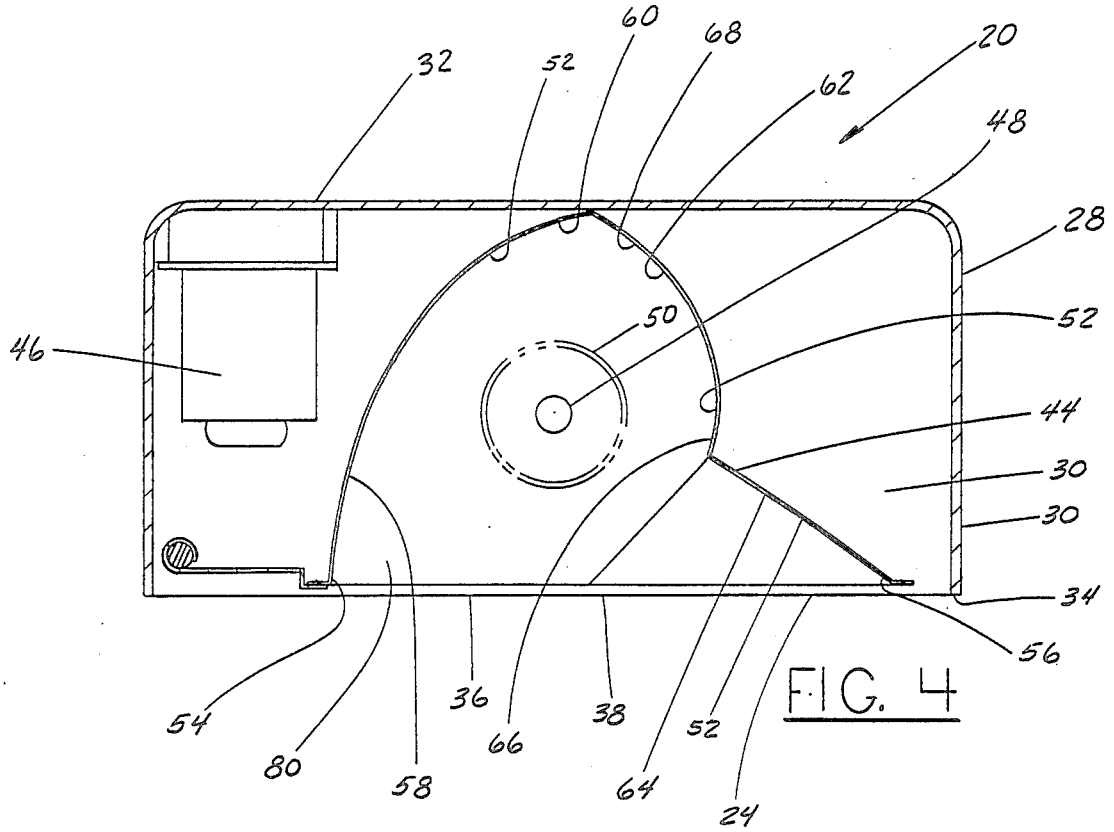
FIG. 4 is a side sectional view taken along section 4—4 as indicated in FIG. 3.

End portions 78 and 80 are oriented at an angle to increase the efficiency of the floodlight. As previously noted and as illustrated best by FIG. 3, end portions 78 and 80 are oriented such that the spacing between them, along lines parallel to the light line, is progressively greater at positions progressively closer to opening plane 38. And, end portions 78 and 80 are also oriented such that the spacing between them, along lines parallel to light line 48, is progressively shorter at positions progressively closer to parabolic section 58, and progressively greater at positions progressively closer to opposite section 62. This tilt of end portions 78 and 80 allows reflections of light from opposite section 62 to be relayed onto parabolic section 58 for subsequent tertiary reflection through opening plane 38.

The reflector system in floodlight 20 may be constructed of reflective aluminum sheeting. Major portion 52, which includes parabolic section 58, connecting section 60, opposite section 62 and partial semi-parabolic section 64, may be made of a single piece of sheeting. Such piece is preferably perforated at certain positions, such as at the position identified by point C and the position identified by point E, as illustrated in FIG. 5.

Planar end portions 78 and 80 are shaped at their peripheries to be joined with major portion 52, and such interconnection may be accomplished by the insertion of tabs along the peripheries of end portions 78 and 80 into slots stamped into major portion 52. The shaping of end members 78 and 80 and such interconnection helps to maintain the sections of major portion 52 in the proper shape and position. Connectors such as screws 84 are used for securing the reflector system to housing 28.

As illustrated in FIG. 1, light-emitting opening plane 38 is covered by a flat light-transmissive cover member 82. Cover member 82 is transparent to avoid any diffusion of light passing therethrough. Cover member 82 is coincident with the opening plane.

While the principles of this invention have been described in connection with specific embodiments, it should be understood clearly that these descriptions are made only by way of example and are not intended to limit the scope of the invention.

What is claimed is:

1. In a floodlight of the type having a straight light line and a reflector surface in a housing and a light-emitting opening plane forward of thel ight line, the improvement wherein the reflector surface comprises a major portion parallel to the light line including:

a parabolic section on one side of the light line with its focus at and its vertex behind and to said one side of the light line, thereby establishing a main beam direction at an acute angle to the opening plane; and an opposite section on the other side of the light line configured and oriented to reflect light therefrom past the light line onto the parabolic section so its secondary reflection off the parabolic section will be close to the main beam direction.

2. The floodlight of claim 1 wherein the opposite section comprises a spiral section configured and oriented to reflect light from the light line through a tightly confined area immediately behind the light line so its secondary reflection off the parabolic section is just off-parallel to the main beam direction.

3. The floodlight of claim 2 wherein the parallel major portion further comprises a partial semi-parabolic section between the spiral section and the opening plane, having its focus at the light line and being oriented to reflect light from the light line in the main beam direction.

4. The floodlight of claim 1 wherein:

the parabolic section extends from near the opening plane and through the vertex to terminate at a first position behind the light line;

the opposite section extends from a second position behind the light line to a third position beside the light line and is progressively closer to the light line at positions thereon progressively closer to the third position; and the parallel major portion further comprises a connecting section between the first and second positions configured and oriented to reflect light from the light line past the opposite section and near the third position.

5. The floodlight of claim 4 wherein the parallel major portion further comprises a partial semi-parabolic section between the third position and the opening plane, having its focus at the light line and being oriented to reflect light from the light line in the main beam direction.

6. The floodlight of claim 4 wherein the opposite section comprises a spiral section extending from the third position to a fourth position between the second and third positions, and being configured and oriented to reflect light from the light line through a tightly confined area immediately behind the light line so its secondary reflection off the parabolic section is just off-parallel to the main beam direction.

7. The floodlight of claim 6 wherein the parallel major portion further comprises a partial semi-parabolic section between the third position and the opening plane, having its focus at the light line and being oriented to reflect light from the light line in the main beam direction.

8. The floodlight of claim 1 wherein the parallel major portion further comprises a partial semi-parabolic section between the opposite section and the opening plane, having its focus at the light line and being oriented to reflect light from the light line in the main beam direction.

9. The floodlight of claim 1 wherein the reflector surface further comprises a pair of facing end portions intersecting the parabolic and opposite sections of the parallel major portion and being intersected by the line defined by the light line, said end portions being oriented such that the spacing therebetween, along lines parallel to the light line, is progressively greater at positions progressively closer to the opening plane.

10. The floodlight of claim 9 wherein the end portions are substantially planar.

11. The floodlight of claim 9 wherein the end portions are oriented such that the spacing therebetween, along lines parallel to the light line, is progressively shorter at positions progressively closer to the parabolic section, whereby such end portions serve to reflect light reflected thereon from the opposite section onto the parabolic section for tertiary reflection through the opening.

12. The floodlight of claim 11 wherein the end portions are substantially planar.

13. The floodlight of claim 12 wherein:

the parabolic section exends from near the opening plane and through the vertex to terminate at a first position behind the light line;

the opposite section extends from a second position behind the light line to a third positio beside the light line and is progressively closer to the light line at positions thereon progressively closer to the third position; and the parallel major portion further comprises a connecting section between the first and second positions configured and oriented to reflect light from the light line past the opposite setion and near the third position.

14. The floodlight of claim 13 wherein the opposite section comprises a spiral section extending from the third position to a fourth position between the second and third positions, and being configured and oriented to reflect light from the light line through a tightly confined area immediately behind the light line so its secondary reflection off the parabolic section is just off-parallel to the main beam direction.

15. The floodlight of claim 14 wherein the parallel major portion further comprises a partial semi-parabolic section between the third position and the opening plane, having its focus at the light line and being oriented to reflect light from the light line in the main beam direction.

16. The floodlight of claim 1 wherein the light-emitting opening plane is covered by a flat light-transmissive cover member.

17. The floodlight of claim 16 wherein the cover member is substantially coincident with the opening plane.

* * * * *

UNITED STATES PATENT AND TRADEMARK OFFICE

CERTIFICATE OF CORRECTION

PATENT NO. : 4,709,312

DATED : November 24, 1987

INVENTOR(S) : Richard V. Heinisch; Ian Lewin

It is certified that error appears in the above-identified patent and that said Letters Patent is hereby corrected as shown below:

In column 1, line 31, change "iluminate" to --illuminate--.

In column 3, line 10, change "betwen" to --between--.

In column 3, line 41, after " "sees" ", insert the word --light--.

In column 3, line 50, change "such" to --Such--.

In column 4, line 1, change "In deed" to --Indeed--.

In column 4, line 44, change "is" to --in--.

In column 6, line 44, change "loaction" to --location--.

In column 7, line 68, change "configure" to --configured--.

In column 8, line 25, change "radiaclly" to --radically--.

In column 9, line 42, change "thel ight" to -- the light--.

In column 10, line 65, change "positio" to --position--.

Signed and Sealed this

Third Day of May, 1988

*Attest:*

DONALD J. QUIGG

*Attesting Officer*

*Commissioner of Patents and Trademarks*

US004709312B1

(12) REEXAMINATION CERTIFICATE (4499th)

United States Patent

Heinisch et al.

(10) Number: US 4,709,312 C1

(45) Certificate Issued: Dec. 11, 2001

(54) FLOODLIGHT WITH IMPROVED REFLECTOR SYSTEM

(75) Inventors: Richard V. Heinisch; Ian Lewin, both of Scottsdale, AZ (US)

(73) Assignee: Ruud Lighting, Inc., Racine, WI (US)

Reexamination Request:
No. 90/005,143, Oct. 5, 1998

Reexamination Certificate for:

| | |
|---|---|
| Patent No.: | **4,709,312** |
| Issued: | **Nov. 24, 1987** |
| Appl. No.: | **06/877,745** |
| Filed: | **Jun. 24, 1986** |

Certificate of Correction issued May 3, 1988.

(51) Int. Cl.[7] ..... F21V 7/00

(52) U.S. Cl. ..... 362/298; 362/346

(58) Field of Search ..... 362/297, 298, 362/300, 303, 307, 343, 346, 804

(56) References Cited

U.S. PATENT DOCUMENTS

| | | | |
|---|---|---|---|
| 3,679,893 | 7/1972 | Shemitz et al. | 240/103 R |
| 4,229,779 | 10/1980 | Bilson et al. | 362/217 |
| 4,379,322 | 4/1983 | Kelly | 362/300 |

*Primary Examiner*—Y Quach

(57) ABSTRACT

A cut-off floodlight of the type having a straight light line, a reflector surface in a housing, and a light-emitting opening, and characterized by a reflector surface with a major portion parallel to the light line including a parabolic section on one side of the light line with its focus at and its vertex behind and to said one side of the light line to establish a main beam direction at an acute angle to the opening plane, and an opposite section on the other side of the light line to reflect light therefrom past the light line onto the parabolic section so its secondary reflection off the parabolic section will be close to the main beam direction.

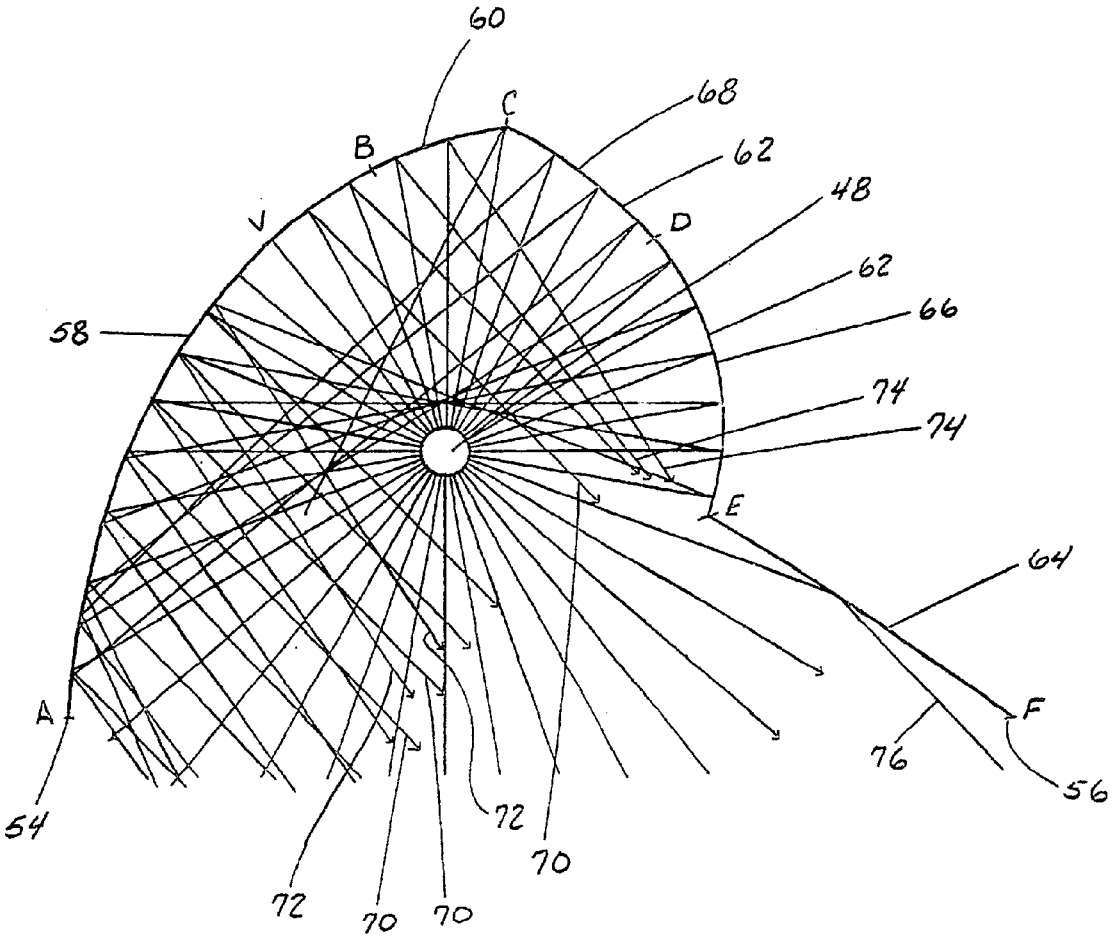

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–6, 8–11, 16 and 17 are cancelled.

Claims 7 and 12 are determined to be patentable as amended.

Claims 13–15, dependent on an amended claim, are determined to be patentable.

New claims 18–24 are added and determined to be patentable.

7. The floodlight of claim [6] *22* wherein the parallel major portion further comprises a partial semi-parabolic section between the third position and the opening plane, having its focus at the light line and being oriented to reflect light from the light line in the main beam direction.

12. The floodlight of claim [11] *24* wherein the end portions are substantially planar.

*18. In a floodlight of the type having a straight light line and a reflector surface in a housing and a light-emitting opening plane forward of light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past the light line onto the parabolic section so its secondary reflection off the parabolic section will be close to the main beam; and*

*a partial section between the opposite section and the opening plane, and being oriented to reflect light from the light line generally in the main beam direction.*

*19. A floodlight for illuminating an area therebelow which terminates at a boundary lateral of the floodlight, the floodlight of the type having a straight light line and a horizontal light-emitting opening plane forward of the light line, comprising:*

*a reflector surface having a major portion parallel to the light line, the major portion including:*

*a parabolic section on one side of the light line with its focus at and its vertex behind and to said one side of the light line, thereby establishing a main beam direction at an acute angle to the opening plane such that the main beam is directed towards the boundary of the area to be illuminated; and*

*an opposite section on the other side of the light line configured and oriented to reflect light therefrom past the light line onto the parabolic section so its secondary reflection off the parabolic section will be close to the main beam direction.*

*20. In a floodlight of the type having a straight light line and a reflector surface in a housing and a light-emitting opening plane forward of the light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past the light line onto the parabolic section so its secondary reflection off the parabolic section will be close to the main direction;*

*the opposite section comprising a spiral section configured and oriented to reflect light from the light line through a tightly confined area immediately behind the light line so its secondary reflection off the parabolic section is just off-parallel to the main beam direction; and*

*the parallel major portion further comprising a partial semi-parabolic section between the spiral section and the opening plane, having its focus at the light line and being oriented to reflect light from the light line in the main beam direction.*

*21. In a floodlight of the type having a straight light line and a reflector surface in a housing and a light-emitting opening plane forward of the light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past the light line onto the parabolic section so its secondary reflection off the parabolic section will be close to the main beam direction; and wherein:*

*the parabolic section extends from near the opening plane and through the vertex to terminate at a first position behind the light line;*

*the opposite section extends from a second position behind the light line to a third position beside the light line and is progressively closer to the light line at positions thereon progressively closer to the third position; and*

*the parallel major portion further comprises a connecting section between the first and second positions configured and oriented to reflect light from the light line past the opposite section and near the third position, and a partial semi-parabolic section between the third position and the opening plane, having its focus at the light line and being oriented to reflect light from the light line in the main beam direction.*

*22. In a floodlight of the type having a straight light line and a reflector surface in a housing and a light-emitting opening plane forward of the light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past*

*the light line onto the parabolic section so its secondary reflection off the parabolic section will be close to the main beam direction; and wherein:*

*the parabolic section extends from near the opening plane and through the vertex to terminate at a first position behind the light line;*

*the opposite section extends from a second position behnd the light line to a third position beside the light line and is progressively closer to the light line at positions thereon progressively closer to the third position;*

*the parallel major portion further comprises a connecting section between the first and second positions configured and oriented to reflect light from the light line past the opposite section and near the third position; and*

*the opposite section comprises a spiral section extending from the third position to a fourth position between the second and third positions, and being configured and oriented to reflect light from the light line through a tightly confined area immediately behind the light line so its secondary reflection off the parabolic section is just off-parallel to the main beam direction.*

*23. In a floodlight of the type having a straight light line and a reflector surface in a housing and a light-emitting opening plane forward of the light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past the light line onto the parabolic section so its secondary reflection off the parabolic section will be close to the main beam direction; and*

*wherein the parallel major portion further comprises a partial semi-parabolic section between the opposite section and the opening plane, having its focus at the light line and being oriented to reflect light from the light line in the main beam direction.*

*24. In a floodlight of the type having a straight light line and a reflector surface in a housing and a light-emitting opening plane forward of the light line, the improvement wherein the reflector surface comprises a major portion parallel to the light line including:*

*a parabolic section on one side of the light line with its focus at and its vertex behind and to said one side of the light line, thereby establishing a main beam direction at an acute angle to the opening plane;*

*an opposite section on the other side of the light line configured and oriented to reflect light therefrom past the light line onto the parabolic section so its secondary reflection off the parabolic section will be close to the main beam direction;*

*wherein the reflector surface further comprises a pair of facing end portions intersecting the parabolic and opposite sections of the parallel major portion and being intersected by the line defined by the light line, said end portions being oriented such that the spacing therebetween, along lines parallel to the light line, is progressively greater at positions progressively closer to the opening plane; and*

*wherein the end portions are oriented such that the spacing therebetween, along lines parallel to the light line, is progressively shorter at positions progressively closer to the parabolic section, whereby such end portions serve to reflect light reflected thereon from the opposite section onto the parabolic section for tertiary reflection through the opening.*

* * * * *